US006605204B1

(12) United States Patent
Martyak et al.

(10) Patent No.: US 6,605,204 B1
(45) Date of Patent: Aug. 12, 2003

(54) ELECTROPLATING OF COPPER FROM ALKANESULFONATE ELECTROLYTES

(75) Inventors: Nicholas M. Martyak, Doylestown, PA (US); Michael D. Gernon, Upper Providence, PA (US); Patrick Janney, Ridley Park, PA (US)

(73) Assignee: Atofina Chemicals, Inc., Philadelphia, PA (US)

( * ) Notice: Subject to any disclaimer, the term of this patent is extended or adjusted under 35 U.S.C. 154(b) by 0 days.

(21) Appl. No.: 09/667,268

(22) Filed: Sep. 22, 2000

Related U.S. Application Data

(60) Provisional application No. 60/187,108, filed on Mar. 6, 2000, and provisional application No. 60/159,381, filed on Oct. 14, 1999.

(51) Int. Cl.[7] ..... C25D 5/02

(52) U.S. Cl. ..... 205/123; 205/157; 205/296; 205/298

(58) Field of Search ..... 205/123, 157, 205/296, 298

(56) References Cited

U.S. PATENT DOCUMENTS

| | | | | |
|---|---|---|---|---|
| 2,525,942 A | | 10/1950 | Proell | |
| 2,525,943 A | | 10/1950 | Proell | |
| 3,715,289 A | * | 2/1973 | Cope, Jr. | 205/298 |
| 5,024,736 A | * | 6/1991 | Clauss et al. | 205/297 |
| 5,051,154 A | | 9/1991 | Bernards et al. | |
| 5,328,589 A | | 7/1994 | Martin | |
| 5,385,661 A | | 1/1995 | Andricacos et al. | |
| 5,730,854 A | | 3/1998 | Martin | |

FOREIGN PATENT DOCUMENTS

DE 4338148 A1 11/1993

OTHER PUBLICATIONS

Faust, C. L. et al., "Copper Plating In Alkanesulfonic Acid Baths," The Monthly Review, American Electroplaters Society, No. 34, p. 641–9, (May, 1947).

Faust, C. L. et al., "Copper Plating In Alkanesulfonic Acid Baths," The Monthy Review, American Electroplaters Society, No. 34, p. 709–19, (Jun., 1947).

Cai, Jiqing, "Application of Methanesulfonic Acid In Plating And Finishing for PCB," Diandu Yu Huanbao, Nanhjing Eight Radio Plant (Nanjing, 210018, Peopl. Rep. China), vol. 15 (No. 2), p. 20–2, (Oct., 1995).

Horkans, Jean et al., "Alloying of a Less Noble Metal In Electrodeposited Cu Through Underpotential Deposition," J. Electrochem. Soc., The Electrochemical Society, Inc., vol. 142 (No. 7), p. 2244–2249, (Jul., 1995).

* cited by examiner

*Primary Examiner*—Arun S. Phasge
(74) *Attorney, Agent, or Firm*—Gilbert W. Rudman

(57) ABSTRACT

Disclosed is an improved electrolyte formulation for the electrodeposition of copper onto electronic devices substrates and a process using the formulation. The formulation is a solution which contains copper alkanesulfonate salts and free alkanesulfonic acids and which is intended for the metallization of micron or sub-micron dimensioned trenches or vias.

14 Claims, 3 Drawing Sheets

ELECTROPLATING OF COPPER FROM ALKANESULFONATE ELECTROLYTES

REFERENCE TO RELATED APPLICATIONS

This application claims the benefit of United States Provisional Application Serial No. 60/159,381, filed Oct. 14, 1999 and United States Provisional Application Serial No. 60/187,108, filed Mar. 6, 2000.

BACKGROUND OF THE INVENTION

1. Field of the Invention

This invention relates to aqueous electrolyte formulations based on alkanesulfonic acids. These electrolyte formulations are intended for the electrodeposition of copper, especially on electronic devices.

2. Prior Art

Electrolytic copper plating is a process which deposits a layer of copper on metallic or non-metallic substrates using an external electric current. Commercial copper plating solutions include copper sulfate, copper pyrophosphate, copper fluorborate and copper cyanide. Copper sulfate and copper fluorborate solutions are typically used at medium to high current densities whereas copper pyrophosphate and copper cyanide solutions are used to deposit copper at low to medium current densities. Because of the health concerns associated with handling cyanide salts and/or fluorboric acid and because of the waste-treatment concerns with cyanide, fluoborate and pyrophosphate based systems, the most widely used commercial copper plating electrolyte is based on copper sulfate and sulfuric acid.

Copper sulfate based plating solutions are used to deposit a copper coating on various substrates such as printed circuit boards, automobile parts and household fixtures. The copper ion concentration in typical solutions varies from about 10 grams per liter to about 75 grams per liter. The sulfuric acid concentration may vary from about 10 grams per liter to about 300 grams per liter. Copper solutions intended for the plating of electronic components usually employ low copper metal concentrations and high free acid concentrations.

The use of alkanesulfonic acids in electroplating has been described previously. Proell, W. A. in U.S. Pat. No. 2,525,942 claims the use of alkanesulfonic acid electrolytes in numerous types of electroplating. For the most part, Proell's formulations employed mixed alkanesulfonic acids. In U.S. Pat. No. 2,525,942 Proell made specific claims for lead, nickel, cadmium, silver and zinc. In another U.S. Pat. No. 2,525,943, Proell specifically claims the use of alkanesulfonic acid based electrolytes in copper electroplating, but again only mixed alkanesulfonic acids were used and the exact compositions of the plating formulations were not disclosed. In a separate publication (Proell, W. A.; Faust, C. L.; Agruss, B.; Combs, E. L.; The Monthly Review of the American Electroplaters Society 1947, 34, 541–9) Proell describes preferred formulations for copper plating from mixed alkanesulfonic acid based electrolytes. Dahms, W. and Wunderlich, C. in German Patent No. 4,338,148 described an MSA based copper plating system which incorporates organic sulfur compounds as additives. In a Chinese publication (Jiqing, Cai; Diandu Yu Huanbao 1995, 15(2), 20-2) the author shows some of the benefits of using MSA based acid copper plating formulations. The greatest benefit claimed by Jiqing was a superior surface cleaning and etching prior to the actual plating step. In U.S. Pat. No. 5,051,154 (Bernards, R. F.; Fisher, G.; Sonnenberg, W.; Cerwonka, E. J.; Fisher S.), there are described surface active additives for copper plating with minor mention of MSA as one of a number of possible electrolytes. Andricacos, P. C., Chang, I. C., Hariklia, D. and Horkans, J. in U.S. Pat. No. 5,385,661 discuss a process which allows for the electrodeposition of Cu alloys containing small amounts of tin and lead via under-potential deposition. The Andricacos patent claims that MSA is exceptionally well suited for promoting the proper functioning of this type of process, owing mostly to the weakly complexing nature of MSA/OMs. A paper on this subject (J. Electrochem. Soc.; 1995; 142(7); 2244–2249) was also published.

Increased densities of transistors on silicon wafers has required the development of new metallization technologies for the plating of fine-line structures. Until recently, aluminum was used as the metal interconnect, but recent developments in integrated circuit technology have shown that copper is the preferred metal for interconnects in electronic components. Copper deposited from electroplating solutions has been shown to be the most economical way to meet the needs of the modern interconnect industry.

In the processing of semiconductor devices, several metallization steps are required. This type of metallization has previously been accomplished with vapor deposition techniques. Recently, electroplating techniques capable of metallizing semiconductor components have been developed. Prior to copper electrodeposition, a copper seed layer which acts as a catalyst is deposited on the silicon wafer. This copper seed layer is about 100–500 nm thick. The semiconductor surface is etched with numerous sub-micron dimensioned interconnecting trenches, and copper is next electroplated onto the seed layer with the filling of these trenches from the bottom upward. Because of the high free acid level used in optimized copper sulfate based plating solutions, about 150–200 gram per liter, the copper seed layer is oftentimes attacked and a significant portion of it may dissolve prior to the initiation of the copper electroplating.

Because of the need to deposit a smooth and fine-grained copper deposit, organic grain refining additives are always added to the copper plating solution. For example, Martin, S. in U.S. Pat. No. 5,328,589 describes the use of surface active materials including alcohol alkoxylates and nonionic surfactants as additives in copper plating baths. Martin, S. also discloses in U.S. Pat. No. 5,730,854 the use of alkoxylated dimercaptans as additives in copper plating baths. These additives inhibit copper deposition at high current densities resulting in a continuous and smooth deposit. Such additives are consumed during the deposition process, and a portion of these additives may be incorporated into the copper deposit. The co-deposition of organic additives in a copper deposit may affect the electrical conductivity of the deposit, and frequent analysis is necessary to ensure a constant organic additive concentration in the copper plating solution.

It would be useful in connection with the various processes that deposit copper into trenches and vias on ceramic substrates to have a copper solution that can operate at a lower free acid concentration than existing optimized copper sulfate based solutions. Such solutions will be less corrosive to the copper catalytic seed layer, and they will require a lesser quantity of additives than current copper sulfate based solutions. In addition, these low free alkanesulfonic acid based solutions will allow the deposition of a smoother coating.

SUMMARY OF INVENTION

Figure 1:
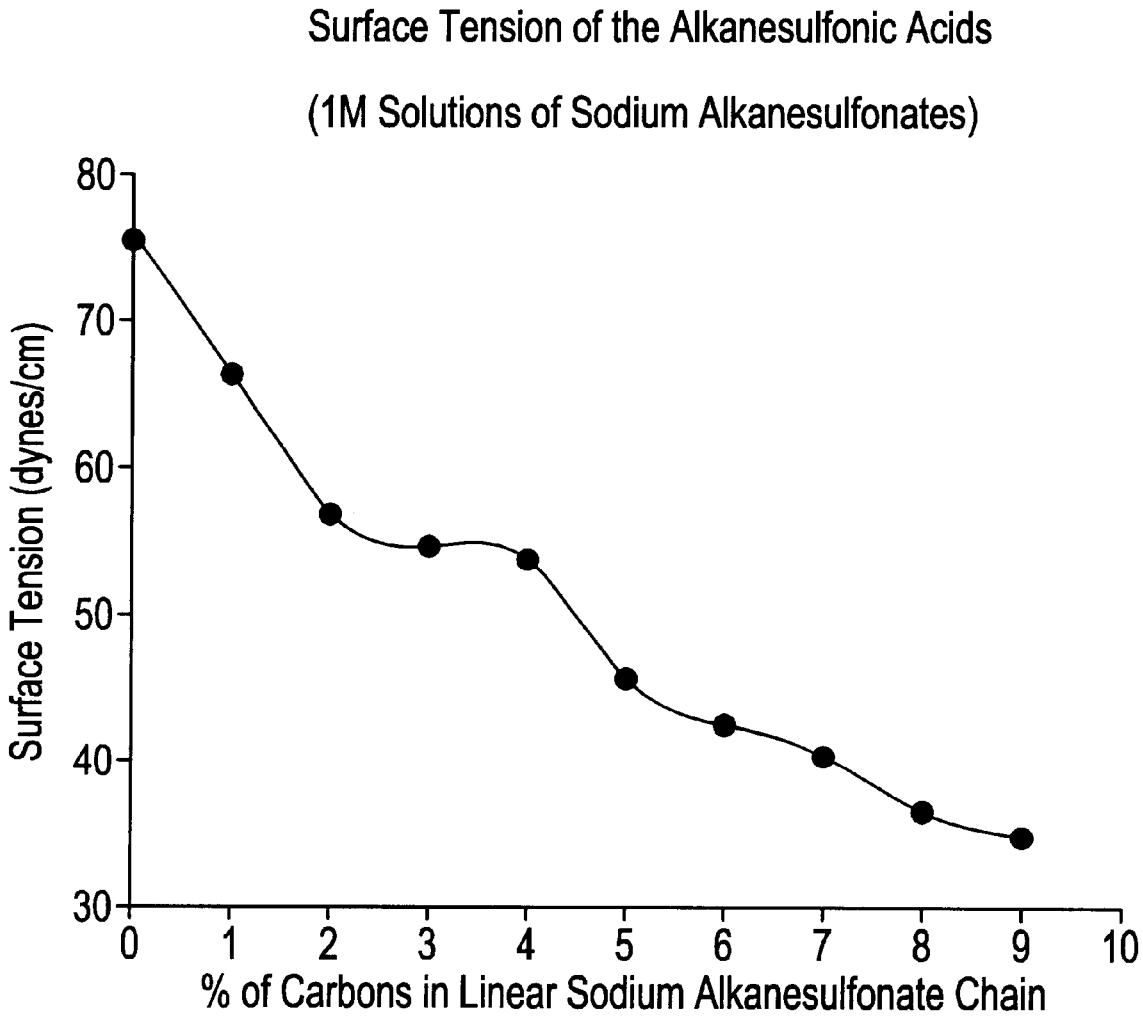
FIG. 1 is a graph illustrating the superior surface tension lowering capability of the alkanesulfonic acids.

An improved electrolyte formulation for the electrodeposition of copper onto electronic devices substrates and a process using this formulation has been developed. The formulation is a solution which contains copper alkanesulfonate salts and free alkanesulfonic acids and which is intended for the metallization of micron or sub-micron dimensioned trenches or vias.

The use of alkanesulfonic acids in place of sulfuric acid results in (a) a less corrosive electrolyte with respect to the copper seed layer, (b) a smoother copper deposit, (c) an electrolyte that can be operated at higher pH and still produce commercially acceptable deposits, (d) electrolytes that operate at lower free acid concentrations (e) an electrolyte that deposits copper at more positives voltages than copper sulfate and (f) electrolytes that have lower surface tension. The electrolytes are based on alkanesulfonic acids. The formulations disclosed are particularly useful for the plating of copper into small trenches or vias of sub-micron dimensions such as occur on the surface of modern electronic devices.

DETAILED DESCRIPTION OF THE INVENTION

The invention is the use of alkanesulfonic acids as a component of acid copper plating electrolytes. The plating electrolytes are further modified by the addition of various functional additives which may be either novel or known in the art.

Recently, the use of electrodeposition for the metallization of chips has been developed, and the plating of copper onto chips has become an application of particular importance. Such chip metallization by electrodeposition requires certain performance criteria which are different than the criteria required for general plating formulations. One unique aspect of chip metallization is the requirement that the deposited metal uniformly fill small sub-micron dimension trenches or vias on the chip surface. The use of alkanesulfonate based electrolytes provides for copper plating systems which are ideal for the metallization of chips as well as for the electrodeposition of acid copper in general.

The copper plating electrolytes described allow for the formulation of copper plating baths which are used to deposit copper into submicron dimensioned trenches such as those which are typically present on the surface of small electronic devices. Existing acid copper plating electrolytes employed for the purpose of metallizing such trenches are based on sulfuric acid. The electrolytes disclosed herein offer less dissolution of seed layer copper prior to plating, and they result in a smoother copper coating. The term "copper plating" includes plating of copper and copper alloys. Copper alloys include metals of Group 1B, 2B, 3B, 4B, 5B, 6B, 7B, 8B and 3A of the periodic table. The term also includes copper composites, such as those including carbon.

Previous investigations in this field have focused on the influence of additives on the quality of the copper deposit and on the performance of the plating bath. Alternatively, this work has focused on the unexpected superiority of C1 through C8 alkanesulfonic acids and their derivatives as electrolytes for copper electroplating. The early studies by Proell showed that the use of mixed alkanesulfonic acids in electroplating and particularly in copper electroplating was possible. However, Proell did not investigate the use of copper alkanesulfonate solutions for depositing copper into finely dimensioned structures. In the present invention it has been found that a metered decrease in free sulfonic acid concentration with respect to an increase in the carbon chain length of the sulfonic acid produces commercially acceptable copper deposits. The ethanesulfonic and propanesulfonic acid based solutions operate best at low free acid concentrations, less than 1.75 M free acid. Such low free acid concentrations minimize the corrosion of copper seed layers. The sulfonate based solutions also deposit a smoother copper coating as compared to sulfuric acid based solutions. In comparison, trifluormethanesulfonate (triflate) based solutions yield commercially acceptable coatings over a wide free acid concentration range.

This invention involves the use of C1 through C8, preferably C1 through C3, alkanesulfonic acids as significant constituents of acid copper plating electrolytes. The alkanesulfonic acids are distinguished from sulfuric acid by their unique balance of physical properties. For instance, the surface tension lowering capability of the alkanesulfonic acids increases with chain length. However, so also does a general decrease in the aqueous solubility of metal alkanesulfonates go up with chain length. The best balance of copper alkanesulfonate solubility and surface tension lowering capability is obtained for the C1 through C8 alkanesulfonic acids. Surface activity is important for plating into sub-micron dimensioned holes, while metal salt solubility is important for plating in general.

Based on theory, this invention can be altered by the use of C1 to C8 alkanesulfonic acid derivatives. Also, this invention can be generalized to the plating of numerous copper alloys including tin/copper.

The copper ion of this invention is preferably also introduced as the salt of an alkanesulfonic acid of formula:

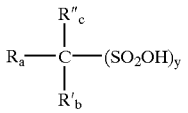

wherein a+b+c+y equals 4,

R, R' and R" are the same or different and each independently may be hydrogen, Cl, F, Br, I, $CF_3$ or a lower alkyl group such as $(CH_2)n$ where n is from 1 to 7, preferably 1 to 3, and that is unsubstituted or substituted by oxygen, Cl, F, Br, I, $CF_3$, —$SO_2OH$, or by any of the groups listed in the discussion immediately below.

The alkanesulfonate portion of the alkanesulfonic acid may be composed of substituted or unsubstituted linear or branched chains of 1 to 8 carbon atoms, preferably 1 to 3 carbon atoms, with monosulfonate or polysulfonate functionalization and with the possibility of further functionalization by one or more other heteroatom containing groups.

Potential substituents on the alkane portion of the sulfonic acid include, for example, alkyl, hydroxyl, alkoxy, acyloxy, keto, carboxyl, amino, substituted amino, nitro, sulfenyl, sulfinyl, sulfonyl, mercapto, sulfonylamido, disulfonylimido, phosphinyl, phosphonyl, carbocyclic and/or heterocyclic groups. Such sulfonic acids preferably include, for example, methanesulfonic acid, ethanesulfonic acid, propanesulfonic acid, butanesulfonic acid, isethionic acid (2-hydroxyethanesulfonic acid), methionic acid (methanedisulfonic acid), 2-aminoethanesulfonic acid and sulfoacetic acid, among others.

Representative sulfonic acids include the alkyl monosulfonic acids such as methanesulfonic, ethanesulfonic and propanesulfonic acids and the alkyl polysulfonic acids such as methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid, 1,3-propylene disulfonic acid, trifluoromethanesulfonic acid, butanesulfonic acid, perfluorobutanesulfonic acid and pentanesulfonic acid.

Because of availability, the sulfonic acids of choice are methanesulfonic, methanedisulfonic, ethanesulfonic, propanesulfonic, trifluormethanesulfonic and perfluorobutanesulfonic acids. The entire copper ion content of the copper plating bath may be supplied in the form of the alkanesulfonic acid salt, or it may be supplied as a mixture of alkanesulfonic acid salt with some other appropriate salt (e.g., copper sulfate).

EXAMPLE 1

The surface tension of copper sulfate and copper alkanesulfonate solutions was measured using a surface goniometer. The copper sulfate and copper sulfonate solutions were prepared by mixing copper carbonate, $CuCO_3$:$Cu(OH)_2$, 57% $Cu^{+2}$, into doubly distilled water. After the copper slurry was adequately mixed, concentrated sulfuric acid, 70% methanesulfonic acid, 70% ethanesulfonic acid, 80% propanesulfonic acid or 50% triflic acid was slowly added until all the carbonate was removed. Additional free acid was added so the final free-acid concentrations were 1.75 M. After dilution to volume, each solution was filtered.

The contact angle for each solution on a freshly prepared copper deposits was:

| Electrolyte | Contact Angle (Degree) |
|---|---|
| Copper Sulfate | 33.61 |
| Copper Methanesulfonate | 27.47 |
| Copper Ethanesulfonate | 26.31 |
| Copper Propanesulfonate | 14.44 |
| Copper Triflate | 15.8 |

It can be seen that the copper alkanesulfonate solutions have the smallest wetting angle thus having the lowest surface tensions.

EXAMPLE 2

Minimizing Copper Corrosion:

Copper sulfate and copper alkanesulfonate solutions were prepared as in Example 1. However, in addition to 1.75 M free acid, copper electrolytes were also prepared having 0.25 M and 0.75 M free acid. Accelerated electrochemical corrosion tests on phosphorized copper were done using a three electrode electrochemical cell. The working electrode was a 1 $cm^2$ area of copper-phosphorus (500 ppm phosphorus). The solutions were tested for corrosivity by scanning from −250 mV of the open circuit potential to +1.6 V of the open circuit potential. The corrosion current density was determined from the electrochemical traces. The corrosion current densities are (in $mA/cm^2$):

| Solution/Free Acid | 0.25M | 0.75M | 1.75M |
|---|---|---|---|
| Copper Sulfate | 0.205 | 1.98 | 6.54 |
| Copper Methanesulfonate | 0.786 | 0.897 | 0.92 |
| Copper Ethanesulfonate | 0.212 | 0.506 | 0.837 |
| Copper Propanesulfonate | 0.112 | 0.742 | 1.54 |
| Copper Trifluoromethane sulfonate | 0.751 | 2.38 | 3.89 |

The most corrosive solutions are the copper sulfate electrolytes. At the high free acid concentration used in today copper plating solutions for electronic devices, 1.75 M, the copper alkanesulfonates are not as corrosive as copper sulfate. The lower corrosivity is important in minimizing copper seed layer corrosion.

EXAMPLE 3

Initiation of Copper Deposition:

The start of copper plating into narrow trenches is important to minimize copper seed layer corrosion. The high free acid concentration of the copper solution increases the propensity for copper seed layer corrosion. Also, the current density at the base of the narrow trench and in particular the bottom edges are very low current density areas. Copper solutions were prepared as in Example 1 but the free acid concentration was adjusted to 0.25 M free acid. Electrochemical studies, cyclic voltammetric (CV) scans, were done to determine the onset of deposition. CV scans were made from +0.3 V were no copper plating occurs and scanning in the cathodic direction until copper plating commenced. The results are:

| | +0.04 V | +0.035 V | +0.030 V | +0.025 V |
|---|---|---|---|---|
| Copper Sulfate | No Plating | No Plating | No Plating | Start of Copper Plating |
| Copper Methanesulfonate | Start of Copper Plating | Plating of Copper | Plating of Copper | Plating of Copper |
| Copper Ethanesulfonate | No Plating | Start of Copper Plating | Plating of Copper | Plating of Copper |
| Copper Propanesulfonate | No Plating | Start of Copper Plating | Plating of Copper | Plating of Copper |
| Copper Triflate | Start of Copper Plating | Plating of Copper | Plating of Copper | Plating of Copper |

It is seen that copper plating from alkanesulfonate solutions starts at more positive potentials compared to copper sulfate electrolytes. Similar results were found for the copper solutions at 0.75 M and 1.75 M free acids: the copper alkanesulfonate solutions deposit copper at more positive potentials than copper sulfate solutions at a given free acid concentration.

EXAMPLE 4

Benefits of Low Free Alkanesulfonic Acid Concentration:

Three copper propane plating solutions were prepared as follows:

1. High Free Acid (1.75 M Free Acid); prepared by dissolving 15.14 gm copper carbonate, $CuCO_3$ :$Cu(OH)_2$, 57% $Cu^{+2}$, into 300 ml water. Propanesulfonic acid (PSA 93.8%), 37 ml, was used to dissolve the copper carbonate powder. An additional 116 ml of 93.8% PSA was added to the solution and the entire solution was diluted to 500 ml. The solution was filtered and 6 mg/l HCl was added to the copper electrolyte. Solution contained 17.26 g/l $Cu^{+2}$ and 214 g/l free PSA.

2. Intermediate Free Acid (0.75 M Free Acid); prepared by dissolving 15.08 gm copper carbonate, $CuCO_3$:$Cu(OH)_2$, 57% $Cu^{+2}$, into 300 ml water. Propanesulfonic acid (PSA 93.8%), 36.5 ml, was used to dissolve the copper carbonate powder. An additional 50 ml of 93.8% PSA was added to the solution and the entire solution was diluted to 500 ml. The solution was filtered and 6 mg/l HCl was added to the copper electrolyte. Solution contained 17.19 g/l $Cu^{+2}$ and 92.5 g/l free PSA.

3. Low Free Acid (0.25 M Free Acid): prepared by dissolving 15.16 gm copper carbonate, $CuCO_3$: Cu $(OH)_2$, 57% $Cu^{+2}$, into 300 ml water. Propanesulfonic acid (PSA 93.8%), 37 ml, was used to dissolve the copper carbonate powder. An additional 17 ml of 93.8% PSA was added to the solution and the entire solution was diluted to 500 ml. The solution was filtered and 6 mg/l HCl was added to the copper electrolyte. Solution contained 17.28 g/l $Cu^{+2}$ and 31.4 g/l free PSA.

To each of the above solutions was added 0.4% v/v of Enthone additive CuBath 70:30.

Brass panels were cathodically cleaned at 4.0 V in a solution containing 50 g/l sodium hydroxide at 50° C. The panels were then rinsed in distilled water and activated by immersion in 5% aqueous propanesulfonic acid. The panels were plated in the above solutions at room temperature for ten minutes.

The deposits from Solution 1 were dull and coarse grained when plated above 25 A/ft$^2$. Solution 2 produced commercially acceptable deposits from 1–30 A/ft$^2$. Solution 3 produced commercially acceptable deposits from 1 to >40 A/ft$^2$.

Similar results were found when copper ethanesulfonate solutions were made.

EXAMPLE 5

Effects of Free Sulfuric Acid Concentration. Three copper sulfate plating solutions were prepared as follows:

1. High Free Acid (1.75 M Free Acid); prepared by dissolving 16.1 gm copper carbonate, $CuCO_3$:$Cu(OH)_2$, 57% $Cu^{+2}$, into 300 ml water. Concentrated sulfuric acid, 7.25 ml was used to dissolve the copper carbonate powder. An additional 47 ml of concentrated sulfuric acid was added to the solution and the entire solution was diluted to 500 ml. The solution was filtered and 6 mg/l HCl was added to the copper electrolyte. Solution contained 18.5 g/l $Cu^{+2}$ and 160 g/l free sulfuric acid.

2. Intermediate Free Acid (0.75 M Free Acid); prepared by dissolving 15.4 gm copper carbonate, $CuCo_3$:$Cu(OH)_2$, 57% $Cu^{+2}$, into 300 ml water. Concentrated sulfuric acid, 7.5 ml, was used to dissolve the copper carbonate powder. An additional 21 ml of concentrated sulfuric acid was added to the solution and the entire solution was diluted to 500 ml. The solution was filtered and 6 mg/l HCl was added to the copper electrolyte. Solution contained 17.56 g/l $Cu^{+2}$ and 71.8 g/l free sulfuric acid.

3. Low Free Acid (0.25 M Free Acid); prepared by dissolving 15.15 gm copper carbonate, $CuCO_3$:$Cu(OH)_2$, 57% $Cu^{+2}$, into 300 ml water. Concentrated sulfuric acid, 7.5 ml, was used to dissolve the copper carbonate powder. An additional 7 ml of concentrated sulfuric acid was added to the solution and the entire solution was diluted to 500 ml. The solution was filtered and 6 mg/l HCl was added to the copper electrolyte. Solution contained 17.28 g/l $Cu^{+2}$ and 23 g/l free sulfuric acid.

To each of the above solutions was added 2 ml/500 ml of Enthone additive CuBath 70:30.

Brass panels were cathodically cleaned at 4.0 V in a solution containing 50 g/l sodium hydroxide at 50° C. The panels were then rinsed in distilled water and activated by immersion in 5% propanesulfonic acid. The panels were plated in the above solutions at room temperature for ten minutes.

The deposits from Solution 1 were commercially acceptable deposits from 1–40 A/ft$^2$. Solution 2 produced commercially acceptable deposits from 1–40 A/ft$^2$. Solution 3 produced dull and coarse grained when plated above 25 A/ft$^2$.

EXAMPLE 6

Comparison of Copper Sulfate to Copper Sulfonate Solutions at an Equivalent High Free Acid Concentration:

Copper sulfate solutions were prepared according to the Enthone Technical Data Sheet, CUBATH SC, used for semiconductor application. The bath was prepared as follows:

1. Cu Sulfate: High Free Acid (1.75 M Free Acid); prepared by dissolving 16.1 gm copper carbonate, $CuCO_3$:$Cu(OH)_2$, 57% $Cu^{+2}$, into 300 ml water. Concentrated sulfuric acid, 7.25 ml was used to dissolve the copper carbonate powder. An additional 47 ml of concentrated sulfuric acid was added to the solution and the entire solution was diluted to 500 ml. The solution was filtered and 6 mg/l HCl was added to the copper electrolyte. Solution contained 18.5 g/l $Cu^{+2}$ and 160 g/l free sulfuric acid. To this solution was added 2 ml/500 ml of Enthone additive CuBath 70:30.

A copper sulfonate solution was prepared in a similar manner as follows:

2. Copper Ethanesulfonate: High Free Acid (1.75 M Free Acid); prepared by dissolving 15.12 gm copper carbonate, $CuCO_3$:$Cu(OH)_2$, 57% $Cu^{+2}$, into 300 ml water. Ethanesulfonic acid (ESA 70%), 24.6 ml, was used to dissolve the copper carbonate powder. An additional 75 ml of 70% ESA was added to the solution and the entire solution was diluted to 500 ml. The solution was filtered and 6 mg/l HCl was added to the copper electrolyte. Solution contained 17.24 g/l $Cu^{+2}$ and 190.8 g/l free ESA. To this solution was added 2 ml/500 ml of Enthone additive CuBath 70:30.

Brass panels were cathodically cleaned at 4.0 V in a solution containing 50 g/l sodium hydroxide at 50° C. The panels were then rinsed in distilled water and activated by immersion in 5% sulfuric acid. The panels were plated in the above solutions at room temperature for ten minutes.

The panels from the copper sulfate solution were bright between 1–40 A/ft$^2$. The panels from the copper ethanesulfonate solution were bright from 1–30 A/ft$^2$ and rough above 30 A/ft$^2$.

EXAMPLE 7

Comparison of Copper Sulfate to Copper Sulfonate Solutions at an Equivalent Low Free Acid Concentration:

Copper sulfate solutions were prepared according to the Enthone Technical Data Sheet, CUBATH SC, used for semiconductor application. The bath was prepared as follows: Prepared by dissolving 15.15 gm copper carbonate, $CuCO_3$:$Cu(OH)_2$, 57% $Cu^{+2}$, into 300 ml water. Concentrated sulfuric acid, 7.5 ml, was used to dissolve the copper carbonate powder. An additional 7 ml of concentrated sulfuric acid was added to the solution and the entire solution was diluted to 500 ml. The solution was filtered and 6 mg/l HCl was added to the copper electrolyte. Solution contained 17.28 g/l $Cu^{+2}$ and 23 g/l free sulfuric acid.

A copper propanesulfonate solution was prepared in a similar manner as follows: Prepared by dissolving 15.16 gm copper carbonate, $CuCO_3$:$Cu(OH)_2$, 57% $Cu^{-2}$, into 300 ml water. Propanesulfonic acid (PSA 93.8%), 37 ml, was used to dissolve the copper carbonate powder. An additional 17 ml of 93.8% PSA was added to the solution and the entire solution was diluted to 500 ml. The solution was filtered and 6 mg/l HCl was added to the copper electrolyte. Solution contained 17.28 g/l $Cu^{+2}$ and 31.4 g/l free PSA.

Brass panels were cathodically cleaned at 4.0 V in a solution containing 50 g/l sodium hydroxide at 50° C. The panels were then rinsed in distilled water and activated by immersion in 5% sulfuric acid. The panels were plated in the above solutions at room temperature for ten minutes.

The panels from the copper sulfate solution were bright between 1–25 A/ft$^2$ and rough above 30 A/ft$^2$. The panels from the copper propanesulfonate solution were bright from 1–40 A/ft$^2$.

EXAMPLE 8

Use of Fluorinated Sulfonic Acids:

Copper triflate plating solutions were prepared as follows:

1. Copper Triflate: High Free Acid (1.75 M Free Acid); prepared by dissolving 15.16 gm copper carbonate, $CuCO_3$:$Cu(OH)_2$, 57% $Cu^{+2}$, into 300 ml water. Triflic Acid (50% v/v), 48.1 ml was used to dissolve the copper carbonate powder. An additional 155 ml of 50% v/v triflic acid was added to the solution and the entire solution was diluted to 500 ml. The solution was filtered and 6 mg/l HCl was added to the copper electrolyte. Solution contained 16.82 g/l $Cu^{+2}$ and 262 g/l free triflic acid.

2. Copper Triflate: Intermediate Free Acid (0.75 M Free Acid); prepared by dissolving 15.20 gm copper carbonate, $CuCO_3$:$Cu(OH)_2$, 57% $Cu^{+2}$, into 300 ml water. Triflic Acid (50% v/v), 48 ml, was used to dissolve the copper carbonate powder. An additional 66 ml of 50% v/v triflic acid was added to the solution and the entire solution was diluted to 500 ml. The solution was filtered and 6 mg/l HCl was added to the copper electrolyte. Solution contained 17.33 g/l $Cu^{+2}$ and 112.5 g/l free triflic acid.

3. Copper Triflate: Low Free Acid (0.25 M Free Acid); prepared by dissolving 15.0 gm copper carbonate, $CuCO_3$:$Cu(OH)_2$, 57% $Cu^{+2}$, into 300 ml water. Triflic Acid (50% v/v), 48 ml, was used to dissolve the copper carbonate powder. An additional 22 ml of 50% v/v triflic acid was added to the solution and the entire solution was diluted to 500 ml. The solution was filtered and 6 mg/l HCl was added to the copper electrolyte. Solution contained 17.10 g/l $Cu^{+2}$ and 37.5 g/l free triflic acid.

To each of the above solutions was added 0.4% v/v of Enthone additive CuBath 70:30.

Brass panels were cathodically cleaned at 4.0 V in a solution containing 50 g/l sodium hydroxide at 50 oC. The panels were then rinsed in distilled water and activated by immersion in 5% propanesulfonic acid. The panels were plated in the above solutions at room temperature for ten minutes.

Unlike the panels plated from either copper sulfate, copper methanesulfonate, copper ethanesulfonate or copper propanesulfonate solutions which showed variations in the copper deposit quality with concentration of free acid, the deposits from Solutions 1, 2 and 3 using triflic acid all produced bright, commercially acceptable deposits from 1 to >40 A/ft2.

EXAMPLE 9

High pH Copper Sulfonate Solutions: Copper sulfate and copper sulfonate solutions were prepared so the pH varied with free acid concentration. The copper sulfate and copper sulfonate solutions were prepared by mixing copper carbonate, $CuCO_3$:$Cu(OH)_2$, 57% $Cu^{-2}$, into doubly distilled water. After the copper slurry was adequately mixed, concentrated sulfuric acid, 70% methanesulfonic acid, 70% ethanesulfonic acid, 80% propanesulfonic acid or 50% triflic acid was slowly added until all the carbonate was removed. Additional free acid was added so the final pH varied as shown in the table below. After dilution to volume, each solution was filtered.

To each of the above solutions was added 0.4% v/v of Enthone additive CuBath 70:30.

Brass panels were cathodically cleaned at 4.0 V in a solution containing 50 g/l sodium hydroxide at 50° C. The panels were then rinsed in distilled water and activated by immersion in 5% aqueous propanesulfonic acid. The panels were plated in the above solutions at room temperature for ten minutes.

| Electrolyte | Low Free Acid | Intermediate Free | High Free Acid |
|---|---|---|---|
| Cu Sulfate | pH = 1.19 Rough Deposit at 30–40 ASF; Bright Deposit from 30 to 1 ASF | pH = 1.05 Bright Panel from 40–1 ASF | pH 0.72 Bright Panel from 40–1 ASF |
| Cu Methanesulfonate | pH 1.40 Rough Deposit at 30–40 ASF; Bright Deposit 30 to 10 ASF | pH = 1.22 Bright Deposit to 10 ASF | pH = 0.96 Bright Panel from 40–1 ASF |
| Cu Ethanesulfonate | pH 2.50 Very Slightly Rough Deposit at >40 ASF; Bright Deposit from 30 to 1 ASF | pH 1.20 Rough Deposit at >40 ASF; Bright Deposit from 30 to 1 ASF | 0.66 Rough Deposit at >40 ASF; Bright Deposit from 30 to 1 ASF |
| Cu Propanesulfonate | pH = 3.40 Very Slightly Rough Deposit at >40 ASF; Bright Deposit from 30 to 1 ASF | pH = 2.40 Slightly Rough Deposit at >40 ASF; Bright Deposit from 30 to 1 ASF | pH = 0.86 Rough Deposit at >40 ASF; Bright Deposit from 30 to 1 ASF |
| Cu Trifluoro-methanesulfonate | pH 1.67 Bright Panel from 40–1 ASF | pH 1.31 Bright Panel from 40–1 ASF | pH 1.02 Bright Panel from 40–1 ASF |

The higher operating pH of the copper ethanesulfonate and copper propanesulfonate solutions still produce bright deposits at low to intermediate current densities. These current density ranges are used in plating electronic devices today. The low free acid and concomitant high pH should help to minimize dissolution of the copper seed layer prior to copper electrodeposition.

EXAMPLE 10

The surface tensions of 1 Molar aqueous solutions of sodium n-alkanesulfonates as a function of chain length are plotted in FIG. 1.

EXAMPLE 11

Figure 2:
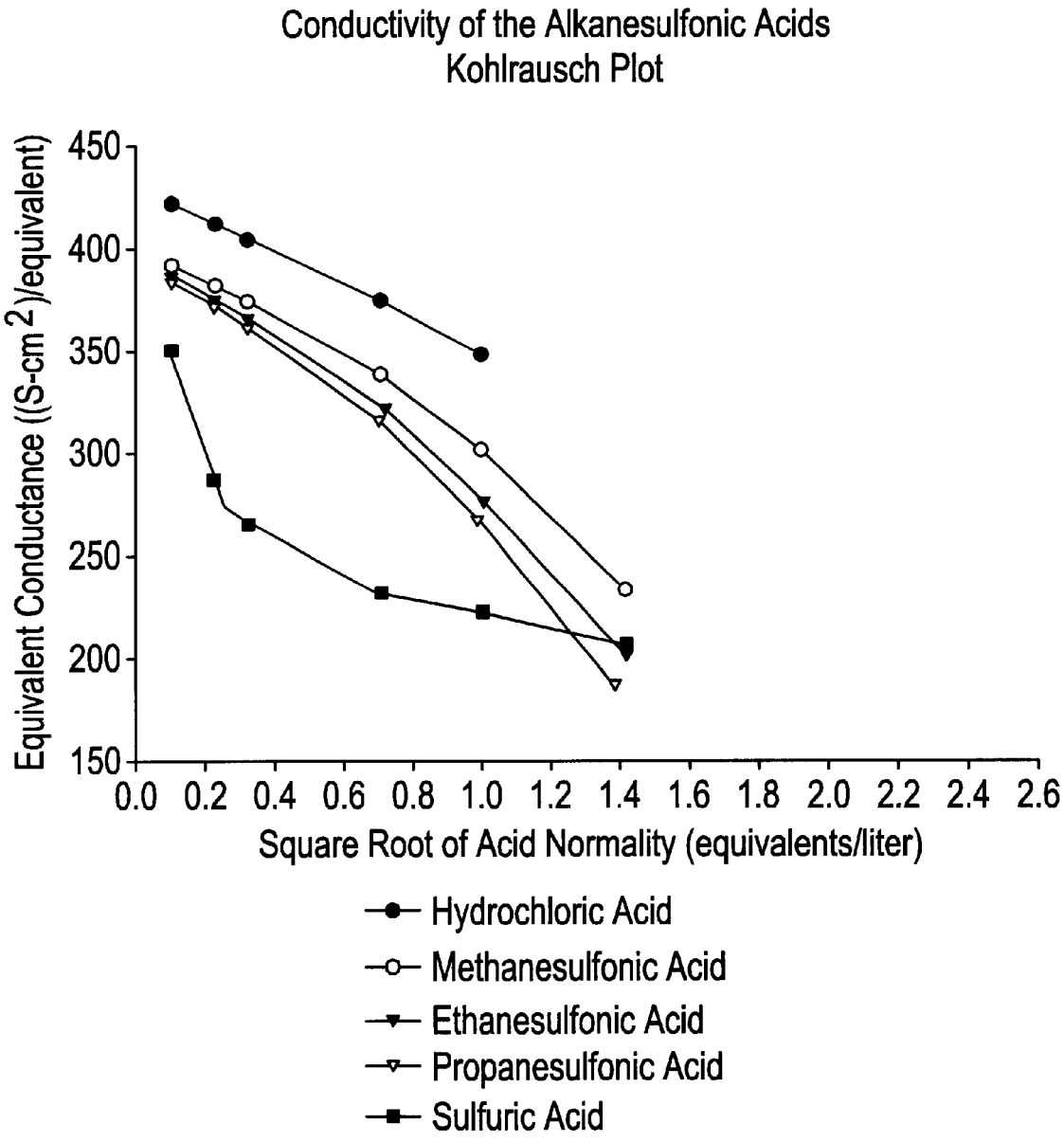
FIG. 2 is a Kohlrausch plot of conductivity for aqueous solutions of hydrochloric acid, sulfuric acid, methanesulfonic acid, ethanesulfonic acid and propanesulfonic acid.

A Kohlrausch plot of conductivity for aqueous solutions of hydrochloric acid, sulfuric acid, methanesulfonic acid, ethanesulfonic acid and propanesulfonic is shown in FIG. 2. Note that the conductivity of the C1 through C3 alkanesulfonic acids decreases with chain length. The conductivity of the C1, C2 and C3 alkanesulfonates is sufficient to allow for optimal electroplating, but the chain length related decrease in conductivity becomes an important negative factor for alkanesulfonate chain lengths longer than 3.

EXAMPLE 12

Figure 3:
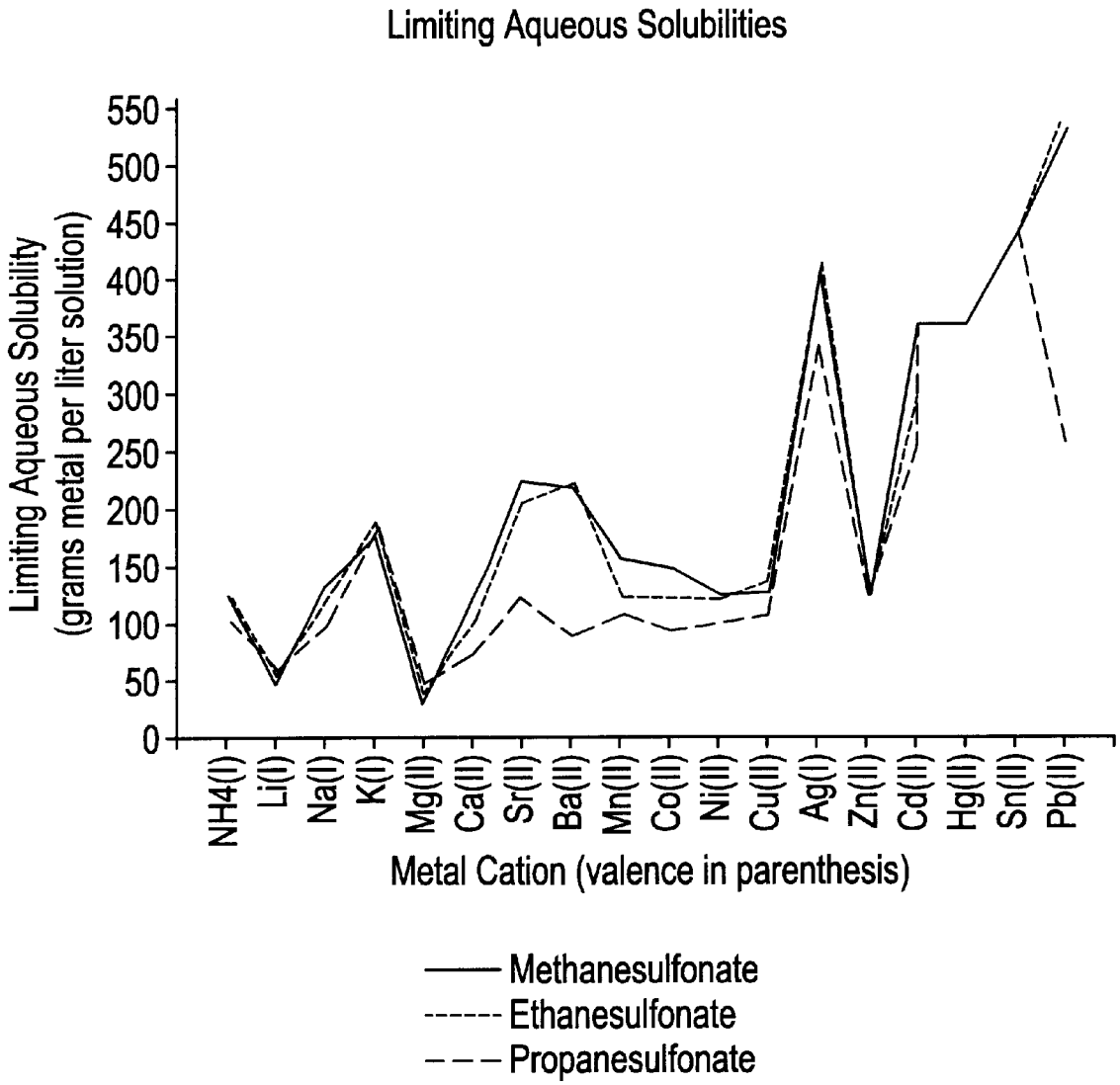
FIG. 3 is a graph illustrating the saturation solubility of a number of metal alkanesulfonates with alkyl chain lengths of 1, 2 and 3.

The saturation solubility of a number of metal alkanesulfonates with alkyl chain lengths of 1, 2 and 3 is shown in FIG. 3. Note that generally the solubilities of the C1, C2 and C3 metal alkanesulfonates decrease with chain length. The solubility of all the C1, C2 and C3 metal alkanesulfonates are sufficient to allow for optimal electroplating, but the chain length related decrease in solubility becomes an important negative factor for alkyl chain lengths longer than 3.

EXAMPLE 13

The anionic mobilities of sulfate, chloride, methanesulfonate, ethanesulfonate and propanesulfonate are listed below. The ionic mobilities were determined using a CE (capillary electrophoresis) technique. The mobility of C1, C2 and C3 alkanesulfonates is sufficient to allow for optimal electroplating, but the chain length related decreased in mobility becomes an important factor for alkanesulfonate chain lengths longer than 3.

| | |
|---|---|
| Sulfate | $5.6 \times 10^{-4}$ cm$^2$/(Volt-sec) |
| Chloride | $6.1 \times 10^{-4}$ cm$^2$/(Volt-sec) |
| Methanesulfonate | $3.8 \times 10^{-4}$ cm$^2$/(Volt-sec) |
| Ethanesulfonate | $3.2 \times 10^{-4}$ cm$^2$/(Volt-sec) |
| Propanesulfonate | $2.9 \times 10^{-4}$ cm$^2$/(Volt-sec) |

What is claimed is:

1. A solution for copper electroplating which contains copper alkanesulfonate salts and free alkanesulfonic acids, wherein the free acid has a concentration from about 0.25 to about 1.75 M, and which is intended for the metallization of micron or sub-micron dimensioned trenches or vias.

2. The solution of claim 1 wherein the alkanesulfonic acid of the anionic portion of the copper salt and any free acid are introduced as an alkyl sulfonic acid of formula:

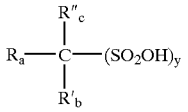

wherein a+b+c+y equals 4,

R, R' and R" are the same or different and each independently may be hydrogen, Cl, F, Br, I, $CF_3$ or a lower alkyl group such as $(CH_2)n$ where n is from 1 to 7 and that is unsubstituted or substituted by oxygen, Cl, F, Br, I, $CF_3$, —$SO_2OH$.

3. The solution of claim 1 wherein the alkanesulfonic acid is derived from an alkyl monosulfonic acid or an alkyl polysulfonic acid.

4. The solution of claim 1 wherein the alkyl sulfonic acid is methanesulfonic, ethanesulfonic and propanesulfonic acids and the alkyl polysulfonic acids are methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid, 1,3-propylene disulfonic acid, trifluormethanesulfonic acid, butanesulfonic acid, perfluorobutanesulfonic acid and pentanesulfonic acid.

5. The solution of claim 1 wherein the alkanesulfonic acid is methanesulfonic acid, ethanesulfonic acid, propanesulfonic acid or trifluormethanesulfonmic acid.

6. The solution of claim 1 wherein the acid is a mixture of an alkanesulfonic acid with other acids.

7. The solution of claim 1 wherein no free acid is used.

8. The solution of claim 1 wherein the copper salt is supplied as a mixture of a copper alkanesulfonate with other copper salts.

9. The solution of claim 1 which is free of chloride ion.

10. A process for the metallization of micron or sub-micron dimensioned trenches or vias, wherein the process employs an electroplating solution containing copper alkanesulfonate salts and free alkanesulfonic acids, wherein the free acid has a concentration of from about 0.25 to about 1.75 M, and electric current is passed through the solution to electroplate copper unto a substrate.

11. The process of claim 10 wherein the substrate is a semiconductor device with a thinly metallized ceramic surface containing micron or sub-micron dimensioned trenches and vias, and wherein the plating solution effectively plates copper into said trenches and vias.

12. The process of claim 10 wherein direct current, pulsed current or periodic reverse current is used.

13. The process of claim 10 wherein the alkanesulfonic acid of the anionic portion of the copper salt and any free acid are introduced as an alkyl sulfonic acid of formula:

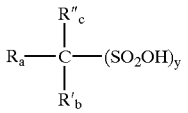

wherein a+b+c+y equals 4,

R, R' and R" are the same or different and each independently may be hydrogen, Cl, F, Br, I, $CF_3$ or a lower alkyl group such as $(CH_2)n$ where n is from 1 to 7 and that is unsubstituted or substituted by oxygen, Cl, F, Br, I, $CF_3$, —$SO_2OH$.

14. The process of claim 10 wherein a soluble or an insoluble or inert anode is used.

* * * * *